US005511932A

United States Patent [19]

Todd et al.

[11] Patent Number: 5,511,932

[45] Date of Patent: Apr. 30, 1996

[54] SKID STEER LOADER BOOM CONTROL SYSTEM

[75] Inventors: Robert R. Todd, Leola; Dale A. Ashcroft, New Holland, both of Pa.

[73] Assignee: New Holland North America, Inc., New Holland, Pa.

[21] Appl. No.: 344,303

[22] Filed: Nov. 22, 1994

[51] Int. Cl.[6] ..... B66C 23/00

[52] U.S. Cl. ..... 414/685; 414/686

[58] Field of Search ..... 414/685, 686, 414/917

[56] References Cited

U.S. PATENT DOCUMENTS

| | | | |
|---|---|---|---|
| 3,215,292 | 11/1965 | Halls . | |
| 3,903,978 | 9/1975 | Kraus | 180/6.48 |
| 3,952,890 | 4/1976 | Armstrong | 414/917 |
| 3,963,131 | 6/1976 | Dimmer . | |
| 3,995,761 | 12/1976 | Hurlburt . | |
| 4,055,262 | 10/1977 | Bauer et al. | 180/89.12 |
| 4,355,946 | 10/1982 | Wykhuis et al. | 414/707 |
| 4,405,280 | 9/1983 | Cochran et al. | 414/685 |
| 4,699,560 | 10/1987 | Ostermeyer et al. | 414/917 |
| 4,892,155 | 1/1990 | Wanamaker | 172/199 |
| 5,169,278 | 12/1992 | Hoechst et al. | 414/685 |

*Primary Examiner*—David A. Bucci
*Assistant Examiner*—Gregory A. Morse
*Attorney, Agent, or Firm*—Frank A. Seemar; Larry M. Miller

[57] ABSTRACT

A skid steer loader having a main frame including a compartment in which an engine and transmission components are contained, ground support wheels extending from the main frame, and a cab mounted on the main frame. The cab includes load bearing side walls extending upwardly from the main frame to define an operators control area therebetween. A boom assembly comprising a pair of arms having material handling front portions and linkage structure that operatively attaches the arms to the cab side walls. The linkage structure includes an upper link coupled to each of the arms and pivotally secured to the cab at a location above the top surface of the wheels, and a lower link which is also pivotally secured to the cab at a location above the wheels. The boom assembly raises and lowers the pair of arms through a generally vertical path adjacent the corresponding load bearing side walls and above the wheels which maximizes the space available in the operator control area, whereas the front portions of the boom arms are thereby moved along generally vertical side-by-side paths.

8 Claims, 3 Drawing Sheets

SKID STEER LOADER BOOM CONTROL SYSTEM

FIELD OF THE INVENTION

The present invention relates generally to front end loaders and more particularly to a boom and linkage system for a skid steer loader.

BACKGROUND OF THE INVENTION

Over the years skid steer loaders have been known as agile, compact vehicles with a high degree of maneuverability and a wide range of applications in the agricultural, industrial and construction fields. These vehicles usually include an engine, a boom assembly and an operators compartment mounted on a frame supported by four ground supporting wheels. Coupled to the engine are a main drive system and a lift system for the boom assembly. The vehicle is maneuvered by driving the wheels on one side at a different speed and/or in a different direction from those on the other side resulting in a turning motion, the severity of which is determined by the relative speeds.

Typically the engine, which is rear mounted for counterbalancing effect, drives a pair of hydrostatic pumps coupled to left and right mounted hydrostatic motors. Wheels on the left and right sides of the vehicle are driven by the left and right mounted motors through gears, chains and sprockets. Motion is usually controlled by an operator seated within the operators compartment by actuating a pair of control levers which are linked to the pumps. The extent to which each lever is moved in a forward direction from a neutral position controls the amount of fluid supplied in a forward direction to its respective motor, and therefore the speed at which the wheels on that side of the vehicle will rotate. Similarly, the extent to which a lever is moved in the reverse direction from the neutral position will control the speed at which the associated wheels rotate in the reverse direction.

As mentioned above, skid steer loaders include a boom assembly. In one common arrangement the boom assembly comprises a pair of lift arms pivotally mounted directly to the main frame, or a support frame extending upwardly from the main frame as shown in U.S. Pat. No. 3,903,978, issued Sep. 9, 1975 in the name of Peter B. Kraus. Material handling attachments, such as the bucket 18 shown in this patent, are usually mounted on the front of the lift arms. U.S. Pat. No. 3,961,131, issued Jun. 15, 1976 in the name of Donald J. Dimmer, and U.S. Pat. No. 4,892,155, issued Jan. 9, 1990 in the name of Richard B. Wanamaker, also are representative of skid steer loader type vehicles having lift arms pivotally affixed to the main frame.

Another well known arrangement found in vehicles of this type comprises a pair of lift arms coupled to the frame by means of a linkage assembly, as best illustrated by U.S. Pat. No. 3,215,292, issued Nov. 11, 1965 in the name of Lawrence M. Halls. This linkage arrangement enhances the path of the bucket by moving it outwardly from vertical as it rises. Similar linkage systems on skid steer loader type vehicles are disclosed in U.S. Pat. No. 3,995,761, issued Dec. 7, 1976 in the name of Joseph C. Hurlburt and U.S. Pat. No. 4,355,946, issued Oct. 26, 1982 in the name of Lloyd A. Wykhuis, et al.

A separate hydraulic system is usually used in skid steer loaders to power the boom assembly via hydraulic lift cylinders coupled to the lift arms. This same system can also be used to actuate one or two tilt cylinders which pivot the attachment relative to the lift arms, which is commonly referred to as dumping or curling the attachment. Typically, a pair of foot pedals in the front of the operator compartment control the flow of hydraulic fluid from an implement pump to the lift and tilt cylinders.

In addition to material handling buckets, various other attachments such as snow blowers, trenchers, tree spades and augers which include their own hydraulic motors and/or cylinders are commonly mounted to the boom assembly. An auxiliary hydraulic system is used to control the flow of hydraulic fluid between the pump and the hydraulic motor of the front mounted attachment. It is common in prior art systems for the flow of hydraulic fluid to the motor to be controlled by an auxiliary spool valve through actuation of a handle on one of the control levers. The handle is normally biased to a neutral position. Pushing the handle in one direction strokes the auxiliary valve in a first direction, thereby causing hydraulic fluid to flow to the front mounted attachment in a first direction. Pushing the handle in the opposite direction strokes the auxiliary valve so as to supply fluid in a reverse direction.

In view of the wide range of applications for skid steer loaders compactness of the unit enhances its value by contributing significantly to its ability to function in constricted areas. To this end, the width of a loader is one of the critical dimensions that determines its ability to work and travel through narrow doors, passageways, and the like. Thus, there is a need to maximize use of the space between the booms, where the cab is located, to improve comfort of the operator in what is in many instances a rigorous work environment and thereby improve his ability to function effectively and augment overall operation of the unit.

In all known prior art apparatus of which applicants are aware there is no system that maximizes the utilization of space between the booms while maintaining a generally enhanced vertical bucket path. Cumbersome obstructions to the cab exist, such as presence of the boom arms or the boom arm mounting structure in the area between the cab and the wheels which significantly reduces the width of the space available and thereby reduces accessible operator space. These obstructions have not been contended with in any way other than by accepting them and reducing the cab space, as for example shown in the Hurlburt and Wannamaker patents, mentioned above, where the boom arms and mounting structure is operative adjacent to the cab and inboard of the wheels.

SUMMARY OF THE INVENTION

An important object of the present invention is to provide a skid steer loader boom control system that is configured to maximize the operator space while not reducing the effectiveness of the path of the material handling attachment.

In pursuance of this and other important objects the present invention contemplates a skid steer loader having a main frame including a compartment in which an engine and transmission components are contained, ground support wheels extending from the main frame, and a cab mounted above the compartment on the main frame, the cab having load bearing side walls extending upwardly from the main frame to define an operators control area therebetween. The skid steer loader further includes a boom assembly comprising a pair of arms and linkage structure for operatively attaching the arms to the load bearing side walls, each of which arms include a front portion having a front end, for supporting material handling means, extending beyond the cab, a rear portion extending behind the cab, and an integral intermediate portion between the front and rear portions. The linkage structure includes an upper link coupled to each of the arms, the upper link being pivotally secured to the cab at a location above the wheels, and a lower link associated with each of the arms, the lower link also being pivotally secured to the cab at a location above the wheels, and power means operatively associated with the boom assembly for raising and lowering in concert each of the pair of arms through a generally vertical path adjacent its corresponding load bearing side wall to which it is attached, whereby the front end of the boom arms travel along generally vertical side-by-side paths.

The foregoing and other objects, features and advantages of the invention will appear more fully hereinafter from a consideration of the detailed description which follows, in conjunction with the accompanying sheets of drawings wherein one principal embodiment of the present invention is illustrated by way of example. It is to be expressly understood, however, that the drawings are for illustrative purposes and are not to be construed as defining the limits of the invention.

DESCRIPTION OF THE PREFERRED EMBODIMENT

Figure 1:
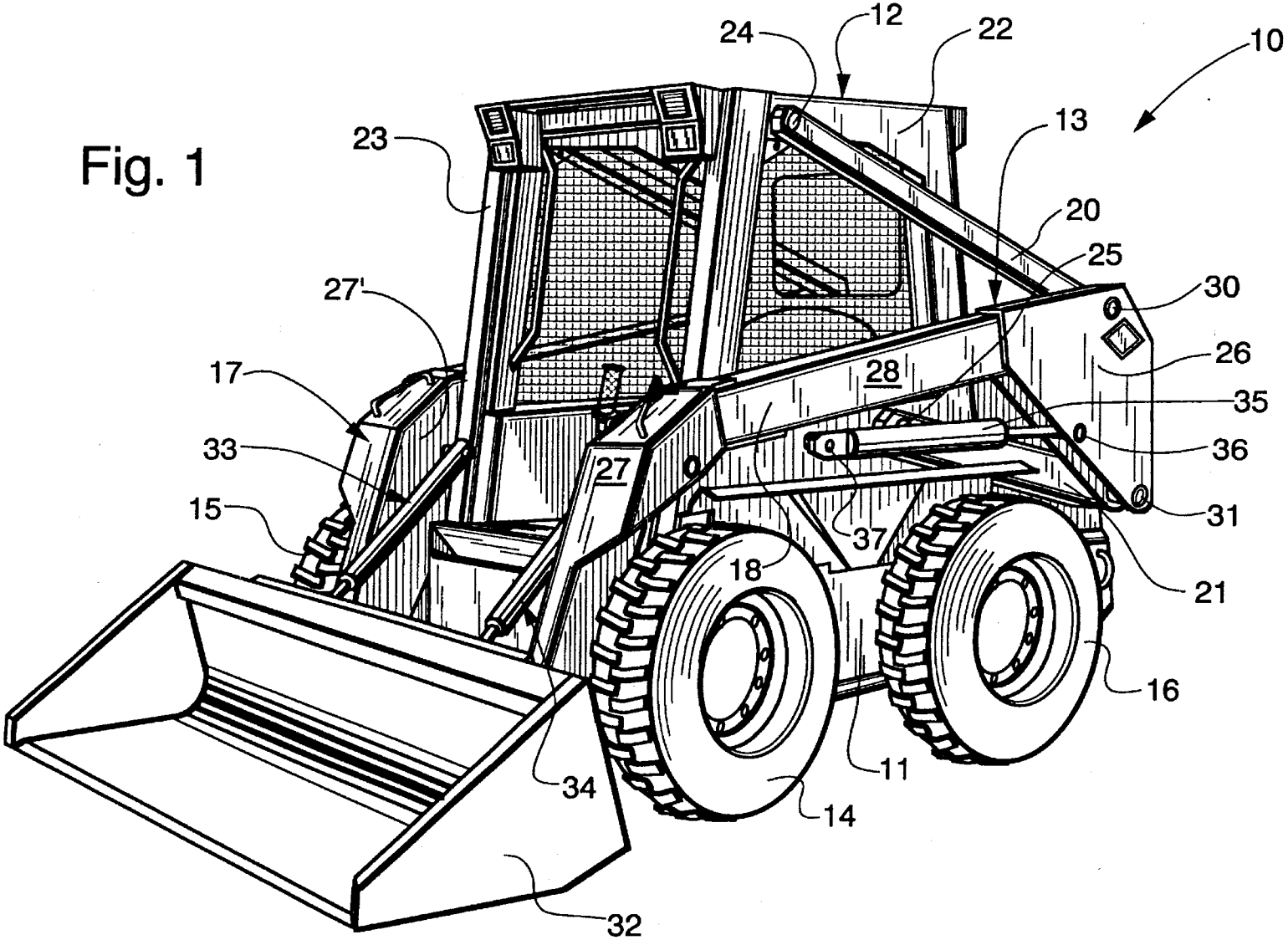
FIG. 1 is a perspective view of a skid steer loader illustrating the preferred embodiment of the present invention.

Referring now to the drawings for a more detailed description of the preferred embodiment of present invention, FIG. 1 shows a skid steer loader 10, which utilizes a four bar linkage system of the type generally disclosed in U.S. Pat. No. 3,215,292, issued Nov. 2, 1965 in the name of L. M. Halls, hereby incorporated by reference. Loader 10 includes a main frame 11, a cab 12 and a boom assembly 13, all of which are supported by a pair of front wheels 14, 15 and a pair of rear wheels 16 (only one shown) mounted on axles (not shown) extending from main frame 11.

A pair of lift arms 17, 18 are swingably mounted via upper links 20 and lower links 21 to load bearing side walls 22, 23 of cab 12 via pivots 24 and 25, respectively. For convenience, because the elements on one side of skid steer loader 10 are paired with similar elements on the other side, only one side of the boom assembly mounting structure will be described in most instances in the following description. Each lift arm, comprising a rear portion 26, a forward portion 27 and an intermediate integral portion 28, accommodates upper link 20 and lower link 21 at pivots 30 and 31, respectively, in the rear portion 26 thereof.

Pivotally mounted to the forward portion 27 of lift arms 17, 18 is an attachment such as a material handling bucket 32 which is rotated with respect to the lift arms in a known manner by means of hydraulic tilt cylinders 33, 34. The entire boom assembly 13 and bucket 32 are raised and lowered by means of a pair of hydraulic cylinders 35, each of which is pivotally mounted to the rear portion 26 of lift arm 17 at a pivot 36 and side wall 22 at pivot 37.

Figure 2:
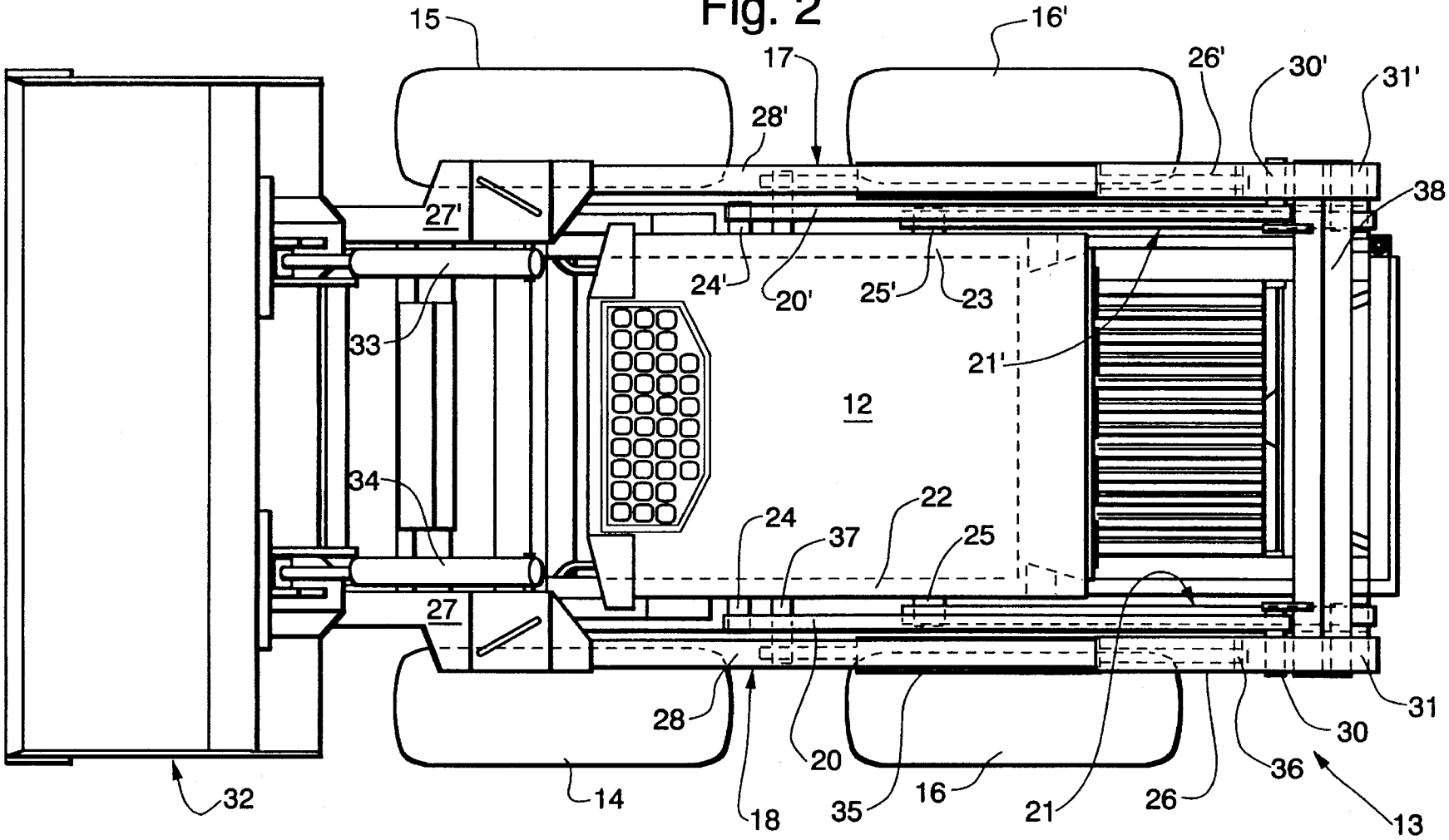
FIG. 2 is a top view of the loader shown in FIG. 1.
Figure 3:
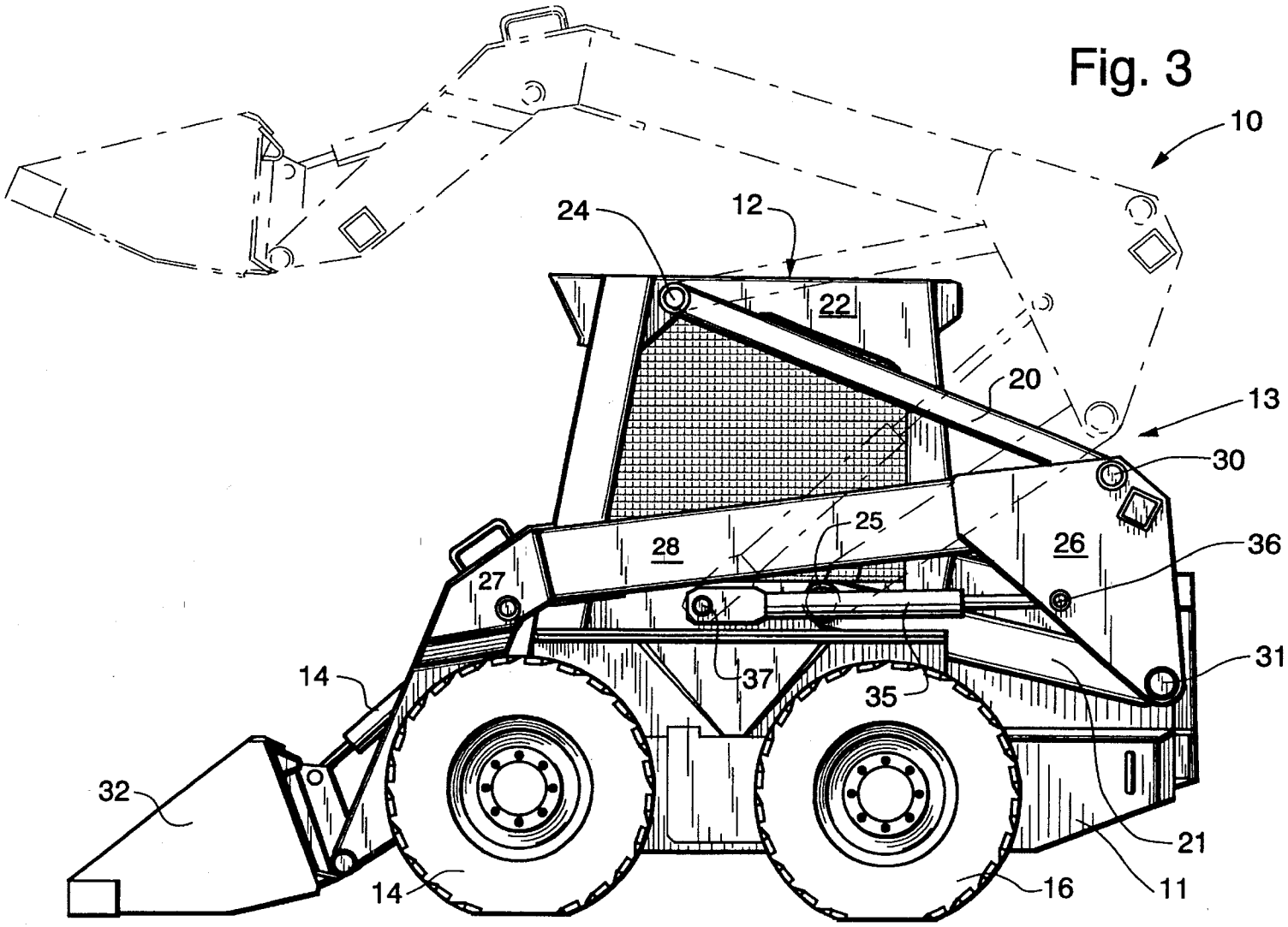
FIG. 3 is a side elevational view of the loader shown in FIG. 1 with the boom and bucket shown in solid lines in the home position and shown in phantom lines to depict a raised position of the bucket.

Now turning to FIGS. 2 and 3, cab 12 is shown with load bearing side walls 22, 23 mounted on main frame 11 and extending upwardly from the outermost side wall thereof to define an operator control area in which various control levers, electrical switches, electronic display devices, etc. are located. The boom assembly 13, having lift arms 17, 18 attached to side walls 22, 23 by a linkage structure, is operative outwardly of the cab with the intermediate portions 28, 28' being disposed above wheels 14, 15, 16, 16' as depicted in FIG. 2. More specifically, intermediate portions 28, 28' are disposed above an imaginary plane through the uppermost point on each of the four wheels, which plane in generally parallel with the ground surface on which the loader is supported by such wheels.

The linkage structure, comprising upper links 20, 20' and lower links 21, 21' are pivotally attached to the cab side walls at 24, 24' and 25, 25' and to lift arms 17, 18 at 30. 30' and 31, 31' to support the entire boom assembly.

Under conditions where the hydraulic cylinders raise the boom assembly to lift bucket 32 from the position shown in solid lines in FIG. 3 to the elevated position shown in phantom in FIG. 3, the lift arms 17, 18 remain above the wheels during the process, which allows the cab to be positioned as shown, i.e., on the outermost location on the frame which accordingly permits the maximum utilization of space above the frame for operator control area between the side walls 22, 23. This is accomplished by the cantilevered pivot arrangement of the linkage structure at 24, 24', 25, 25' and the intermediate portions 28, 28' of arms 17, 18 above the topmost areas of surface of the wheels, i.e., above the imaginary plane mentioned above. The wheels can still be mounted to the side of frame 11 and extend outwardly for a minimum width based on the combined width of the frame and wheels and not be affected by the lift arm path of the boom assembly which is above the wheel in the area adjacent the side walls on which the boom assembly is supported.

Completing the boom assembly are forward portions 27, 27' of lift arms 18, 17 and rear portions 26, 26' of lift arms 18, 17. The forward portions extend beyond cab 12 and then slightly inwardly and downwardly to provide a convenient coupling for bucket 32 in front of the cab in the vicinity of the ground. The rear portions extend behind the back of the cab and are interconnected by transverse support element 38.

In operation, bucket 32 (or other material handling means), shown in the home position in the vicinity of the ground, is loaded in the usual manner. By activating the hydraulic lift cylinder the bucket is raised through a continuous series of intermediate positions until it reaches the position shown in phantom. During this lifting procedure the operator may, if necessary, operate tilt cylinders 33, 34 to dump or curl the bucket relative to forward portions 27, 27' of lift arms 18, 17. During this lifting process the portions of the lift arms adjacent the sides of cab 12 start from a location above the wheels and move upwardly as the bucket is raised, which portion moves in a path that is parallel and adjacent the side walls 22, 23 of cab 12.

Of the many explicit and implicit advantages of the present invention, one of the most important is the provision of a boom assembly for a skid steer loader that is mounted via a linkage system to a load supporting cab in such a manner whereby the side to side space in the cab is not compromised by the location of the path of the lift arms. There is an inherent improvement in the availability of space which enhances the comfort and effectiveness of the operator on one hand or enables the overall width of the skid steer loader to be designed at a reduced dimension which also improves its effectiveness in confined work areas in which it customarily operates.

While preferred structure in which the principles of the present invention are shown and described above, it is to be understood that the invention is not limited to such structure, but that, in fact, widely different means of varying scope and configuration may be employed in the practice of the invention.

Having thus described the invention, what is claimed is:

1. A skid steer loader comprising a main frame including a compartment in which an engine and transmission components are contained, ground support wheels extending from said main frame, a cab mounted in its operative position above said compartment on said main frame, said cab including load bearing side walls extending upwardly from said main frame to define an operators control area therebetween, a boom assembly comprising a pair of arms and linkage structure for operatively attaching said pair of arms to said load bearing side walls, each of said arms including a front portion having a front end, for supporting material handling means, extending beyond said cab, a rear portion extending behind said cab, and an integral intermediate portion between said front and rear portions, said linkage structure including a pair of upper links, means for pivotally coupling one end of each of said upper links to said rear portion of each of said arms, means for pivotally attaching the other end of each of said upper links to said cab at a location above said wheels, a pair of lower links, means for pivotally coupling one end of each of said lower links to said rear portion of each of said arms, and means for pivotally attaching the other end of each of said lower links to said cab at a location above said wheels, and power means operatively associated with said boom assembly for raising and lowering in concert each of said pair of arms through a generally vertical path adjacent its corresponding load bearing side wall to which it is attached, whereby said front end of said boom arms travel along generally vertical side-by-side paths.

2. A skid steer loader as set forth in claim 1 wherein said power means comprise a pair of hydraulic cylinders operatively mounted to extend between said load bearing side walls of said cab at a location above said wheels and said rear portion of said arms, and wherein said means for pivotally attaching the other ends of said upper links to said cab comprise pivot pins cantilevered from the load bearing sidewalls of said cab, said pins and said upper links disposed inboard of said generally vertical paths through which said pair of arms travel under conditions where said boom assembly is moved by said hydraulic cylinders.

3. A skid steer loader as set forth in claim 1 wherein said power means and said boom assembly are adapted to raise said arms from a home position through a continuous series of other raised positions, said intermediate portions of said arms being located in the area directly above said wheels when said arms are in said home position, and said intermediate portions of said arms also being above said wheels in all of said other raised positions of said arms.

4. A skid steer loader as set forth in claim 3 wherein said front ends of said arms are in the general vicinity of the ground under conditions where said arms are in said home position.

5. A skid steer loader as set forth in claim 4 wherein said power means comprise a pair of hydraulic cylinders operatively mounted to extend between said load bearing side walls of said cab at a location above said wheels and said rear portion of said arms, and wherein said means for pivotally attaching the other ends of said upper links to said cab comprise pivot pins cantilevered from the load bearing sidewalls of said cab, said pins and said upper links disposed inboard of said generally vertical paths through which said pair of arms travel under conditions where said boom assembly is moved by said hydraulic cylinders.

6. A skid steer loader as set forth in claim 1 and further comprising a transverse support element extending between said rear portions of said arms, said transverse support element being generally disposed to be intersected along its length by a plane that also intersects and is coextensive with said intermediate portions of said boom arms.

7. A skid steer loader as set forth in claim 6 wherein said power means comprise a pair of hydraulic cylinders operatively mounted to extend between said load bearing side walls of said cab at a location above said wheels and said rear portion of said arms, and wherein said means for pivotally attaching the other ends of said upper links to said cab comprise pivot pins cantilevered from the load Rearing sidewalls of said cab, said pins and said upper links disposed inboard of said generally vertical paths through which said pair of arms travel under conditions where said boom assembly is moved by said hydraulic cylinders.

8. A skid steer loader as set forth in claim 6 wherein said power means and said boom assembly are adapted to raise said arms from a home position through a continuous series of other raised positions, said intermediate portions of said arms being located in the area directly above said wheels when said arms are in said home position, said intermediate portions of said arms also being above said wheels in all of said other raised positions of said arms, and said transverse support element being above said wheels regardless of the position of said arms.

* * * * *